US011458353B2

(12) United States Patent
Hopson et al.

(10) Patent No.: US 11,458,353 B2
(45) Date of Patent: Oct. 4, 2022

(54) EXERCISE BIKE SYSTEM

(71) Applicants: Pamela D Hopson, Dayton, OH (US); Walter Lee Brewer, Trotwood, OH (US)

(72) Inventors: Pamela D Hopson, Dayton, OH (US); Walter Lee Brewer, Trotwood, OH (US)

( * ) Notice: Subject to any disclaimer, the term of this patent is extended or adjusted under 35 U.S.C. 154(b) by 88 days.

(21) Appl. No.: 17/013,512

(22) Filed: Sep. 4, 2020

(65) Prior Publication Data

US 2022/0072362 A1 Mar. 10, 2022

(51) Int. Cl.
*A63B 22/00* (2006.01)
*A63B 22/06* (2006.01)
(Continued)

(52) U.S. Cl.
CPC ..... *A63B 22/0012* (2013.01); *A63B 21/225* (2013.01); *A63B 21/4034* (2015.10);
(Continued)

(58) Field of Classification Search
CPC ..... A63B 22/0012; A63B 22/0605; A63B 21/225; A63B 21/4034; A63B 21/4035; A63B 23/128; A63B 23/03525; A63B 23/1218; A63B 23/03558; A63B 23/0476; A63B 23/03575; A63B 1/00; A63B 2022/0611; A63B 2022/0617; A63B 2022/0623; A63B 2022/0629; A63B 2022/0635; A63B 2022/0641; A63B 2022/0647; A63B 2022/0652; A63B 2022/0658; A63B 69/16; A63B 2069/161;
(Continued)

(56) References Cited

U.S. PATENT DOCUMENTS 8,585,561 B2 * 11/2013 Watt ..... A63B 21/0051 482/57
2005/0272567 A1 * 12/2005 Ditolla ..... A63B 22/0605 482/62

(Continued)

OTHER PUBLICATIONS

Power Tower Adiustable Heioht Dip Station Pull Up Bar for Home Gym, GoodsOutlet, Accessed Dec. 22, 2021. https://goodsoutlet.shop/product/_1123331.html (Year: 2019).*

*Primary Examiner* — Erin Deery
*Assistant Examiner* — Peter H Forstner
(74) *Attorney, Agent, or Firm* — Inventa Capital PLC

(57) ABSTRACT

An exercise bike machine includes a first frame having a front end and a rear end, and a second frame. The first frame supports a seat, handlebars, and a flywheel attached thereto, and pedals rotatably attached to the first frame and operatively connected to the flywheel. The seat includes a seat tube extending therefrom that is slidably received by a rear support tube supported by and connected to the first frame. The second frame includes a mechanical connection for removably engaging the first frame. The second frame includes a top section and a bottom section that are selectively movable relative one another along a vertical axis. The top section has a bar element allowing a user to hold onto and pull up to the bar element while peddling the flywheel, which may provide for both cardiovascular and CrossFit training and exercise for the user.

6 Claims, 6 Drawing Sheets

(51) Int. Cl.

| | |
|---|---|
| ***A63B 21/22*** | (2006.01) |
| ***A63B 23/035*** | (2006.01) |
| ***A63B 21/00*** | (2006.01) |
| ***A63B 23/12*** | (2006.01) |

(52) U.S. Cl.
CPC ..... *A63B 21/4035* (2015.10); *A63B 22/0605* (2013.01); *A63B 23/03525* (2013.01); *A63B 23/1218* (2013.01)

(58) Field of Classification Search
CPC ..... A63B 2069/162; A63B 2069/163; A63B 2069/164; A63B 2069/165; A63B 2069/166; A63B 2069/167; A63B 2069/168
See application file for complete search history.

(56) References Cited

U.S. PATENT DOCUMENTS

| | | | | |
|---|---|---|---|---|
| 2011/0077125 | A1* | 3/2011 | Kenyon | A63B 22/0605 482/4 |
| 2013/0102443 | A1* | 4/2013 | Lundquist | A63B 21/4035 482/93 |
| 2019/0240521 | A1* | 8/2019 | Staten | A63B 23/1218 |
| 2020/0101342 | A1* | 4/2020 | Lawton | A63B 21/4033 |

* cited by examiner

EXERCISE BIKE SYSTEM

FIELD OF THE INVENTION

The present invention generally relates to exercise equipment, and more particularly to stationary exercise bikes.

BRIEF DESCRIPTION OF THE INVENTION

Today all relatively recent trends towards physical fitness awareness have led to an increase in the number of individuals exercising on a regular basis in order to keep physically fit. Several types of exercise equipment are currently in use to provide exercise to persons who wish to keep physically fit without venturing outdoors. One of the most popular of such indoor exercise devices is the stationary exercise bicycle whereby a person pedals a simulated bicycle as a form of exercise.

Early exercise bicycles included apparatus designed to support a conventional bicycle so that the rear wheel thereof can rotate against a frictional load. These types of devices fall into several general categories, the first of which connects the front axle and the bottom bracket of the bicycle to a frame in order to support the bicycle. As with other exercise equipment, exercise bicycles are continually evolving.

Early exercise bicycles were primarily designed for daily in-home use and adapted to provide the user with a riding experience similar to riding a bicycle in a seated position. In many examples, early exercise bicycles include a pair of pedals to drive a single front wheel. To provide resistance, early exercise bicycles and some modern exercise bicycles were equipped with a friction brake.

Such early exercise bicycles may include a magnetic braking system to resist rotation of a flywheel. The magnetic braking system may be magnets mounted on brackets selectively pivoted relative to the frame to increase or decrease the resistance opposing rotation of the flywheel. The brackets may be pivoted using a brake adjustment assembly joined to the brackets in such a manner that the magnetic forces resisting rotation of the flywheel increase or decrease in a proportional manner over at least a portion of the adjustment range of the brake adjustment assembly. The early exercise bicycles may further include a console that displays information, such as power. The power may be estimated from a look-up table using the crank or flywheel speed of the exercise bike measured using a speed sensor and the tilt angle of the brackets relative to a reference point measured using a power sensor that includes an accelerometer.

Also, the early exercise bicycles may include load-providing components allowing for fine-tuned adjustment of the selected load. The load providing components are made of relatively simple mechanical components so as to increase the reliability, reduce the maintenance and provide a relatively smooth cycling feel.

Although the early exercise bicycles are in many ways effective for their intended use, there is nonetheless a need for a new and improved exercise bicycle. The present invention aims to solve this problem by simple and convenient means.

SUMMARY OF THE INVENTION

An exercise bike machine includes a first frame presenting a front end and a rear end, the first frame supports and is attached to a seat, handlebars and a flywheel, also comprising pedals rotatably attached to the first frame and operatively connected to the flywheel. The first frame further includes a rear support tube adapted to receive a seat tube. The seat tube is slidably located in the rear support tube. A second frame presents a mechanical connection for removable engaging the second frame with the first frame, the mechanical connection defined at the rear end of the first frame and the second frame and the second frame and the rear support tube. The second frame includes a bottom section and a top section selectively movable relative to one another along an axis A.

The top section presents a bar element to allow a user to peddle the flywheel by holding the bar and pull up at the bar to effect heart rate, to burn more calories, and to further raise metabolism. The exercise bike machine of the present invention works by peddling the bike by holding the handle bars and or the pull up bar, and as a user pedals, the user is able to adjust the intensity knob to a desired level as the user goes back and forth to the handle bars and pull up bar.

An advantage of the present invention is to provide an exercise bike machine that effects heart rate, burns calories, and raises metabolism. Another advantage of the present invention is to provide the exercise bike machine that is also great for cardiovascular and CrossFit® training.

Still another advantage of the present invention is to provide the exercise bike machine that works the entire leg, latissimus dorsi and back muscles of the user, as well as the core, abdominal and oblique area.

Still another advantage of the present invention is that the exercise bike machine provides for the best overall full body workout machine because the machine targets more muscle groups at one time than anything in its class or anything on the market at this time.

Yet another advantage of the present invention is that the exercise bike provides the user the best combination of light strength training and cardio, or calisthenics and cardio mixed with CrossFit® in one machine or workout.

The objects and advantages of the present invention will be more readily apparent from inspection of the following specification, taken in connection with the accompanying drawing, wherein like numerals refer to like parts throughout and in which an embodiment of the present invention is described and illustrated.

The exact manner in which the foregoing and other objects and advantages of the invention are achieved in practice will become more clearly apparent when reference is made to the following detailed description of the preferred embodiments of the invention described in detail in the following specification and shown in the accompanying drawings, where in like reference numbers indicate corresponding parts throughout.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
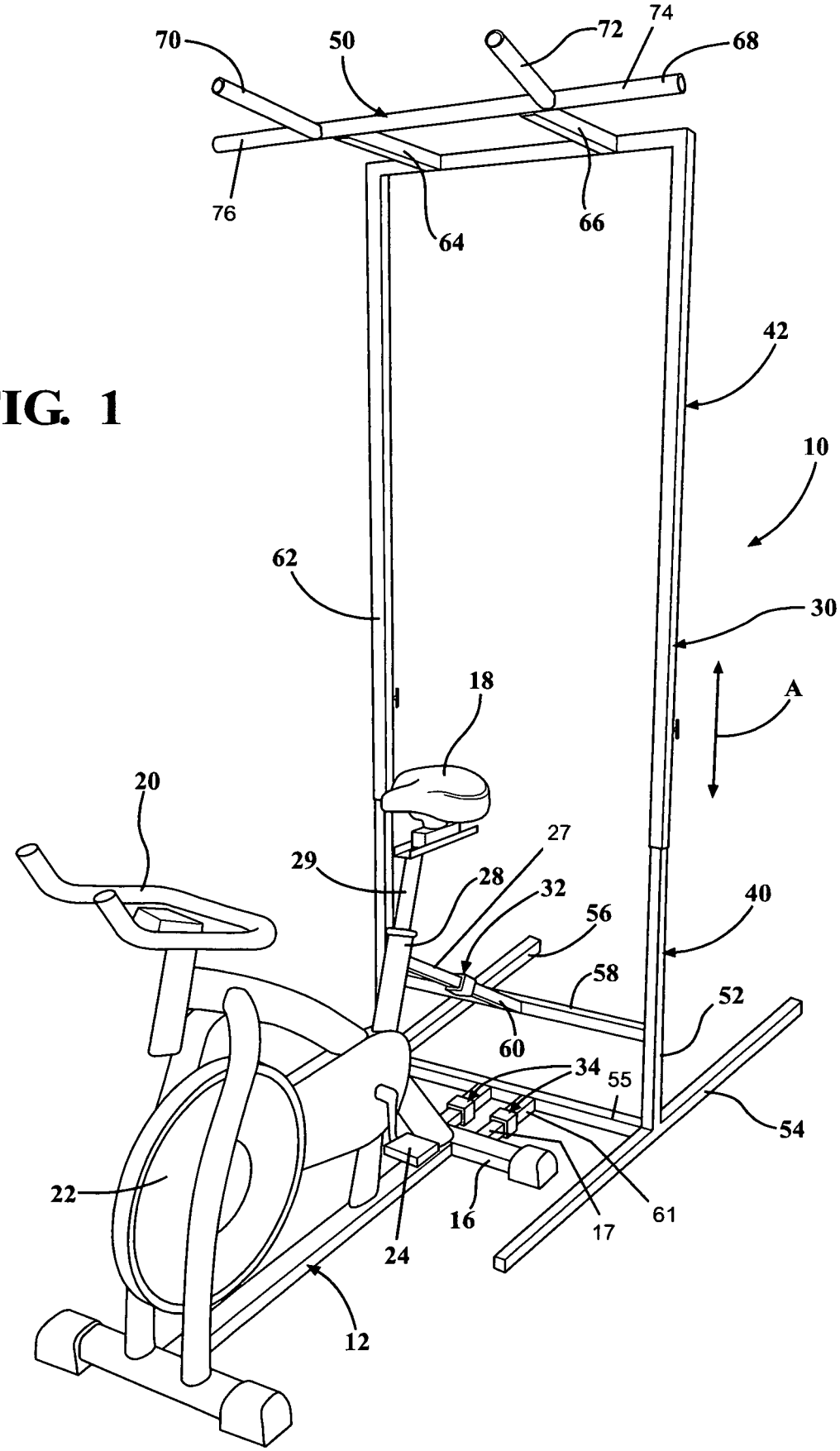
FIG. 1 illustrates a perspective view of an exercise bike machine of the present invention.
Figure 2:
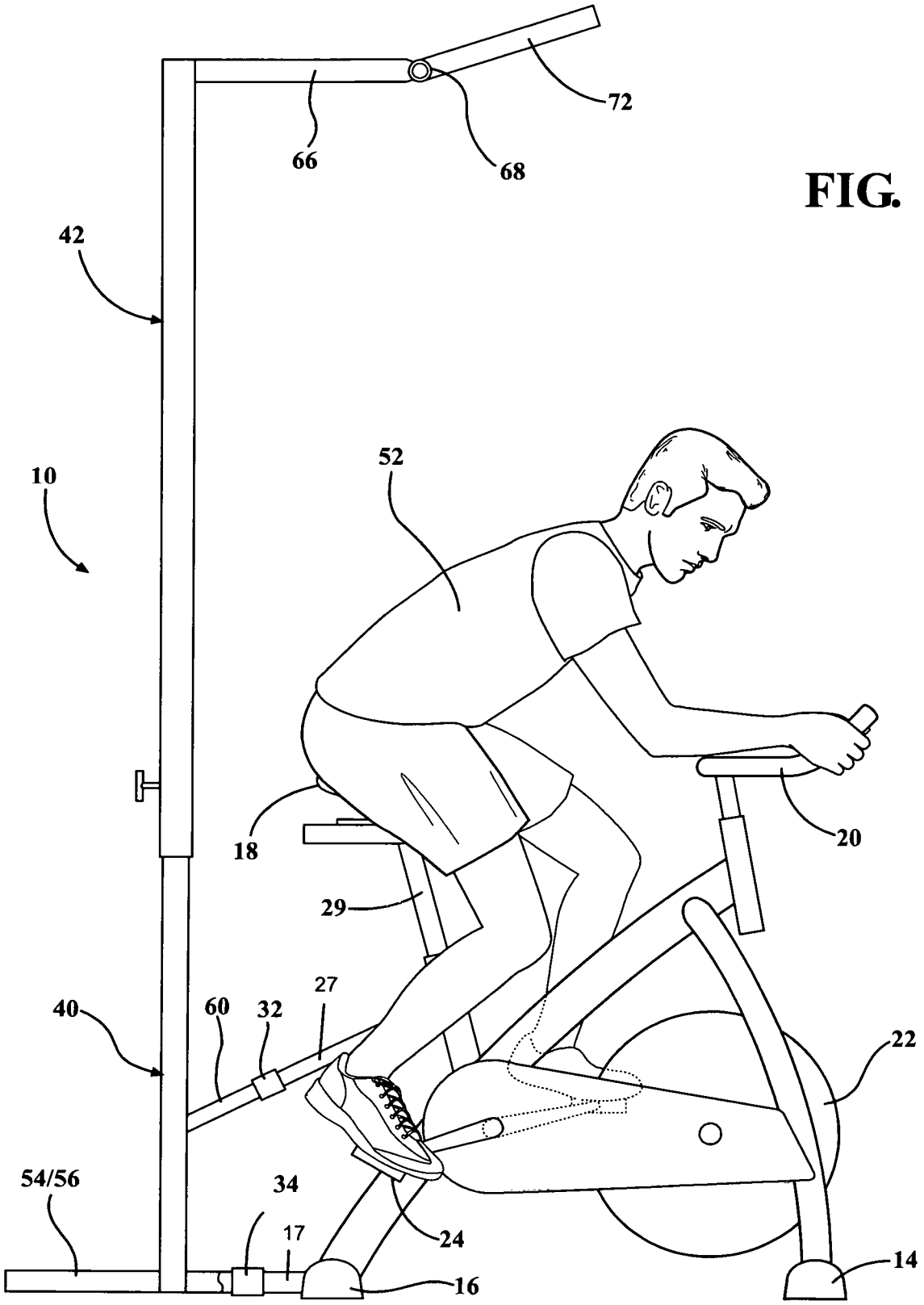
FIGS. 2 through 6 illustrate various side views of the exercise bike machine with a user exercising various muscle groups.
Figure 3:
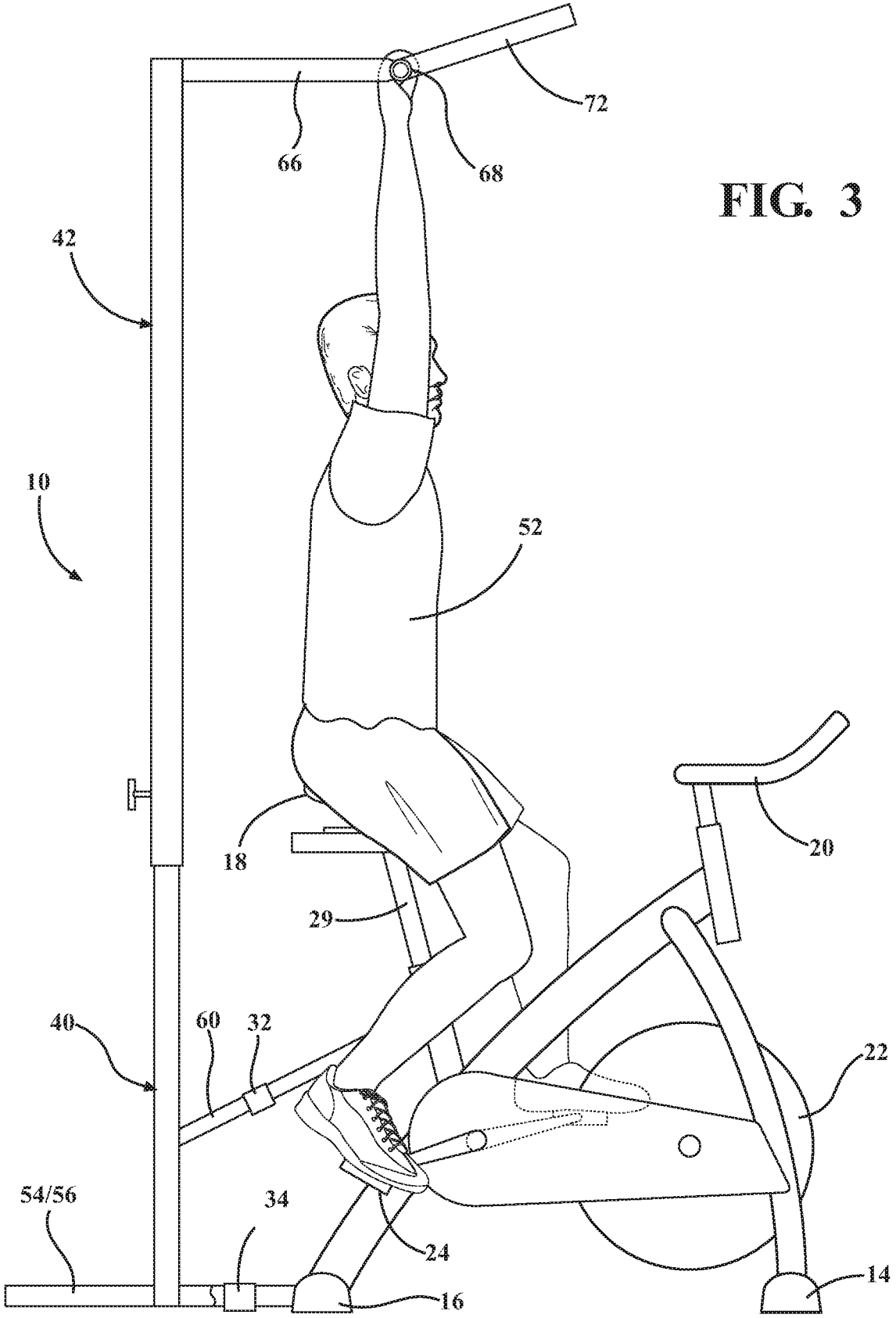
Figure 4:
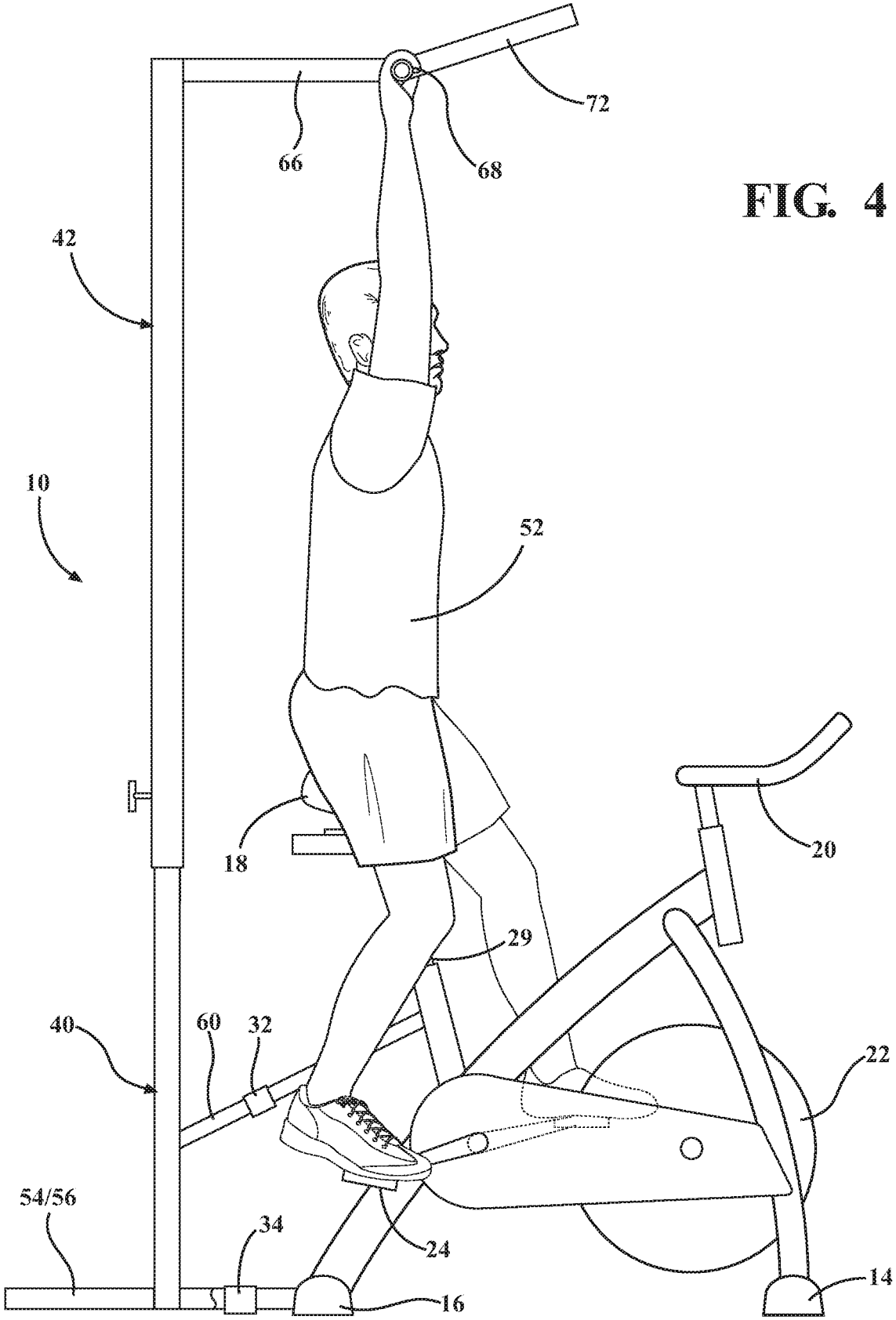
Figure 5:
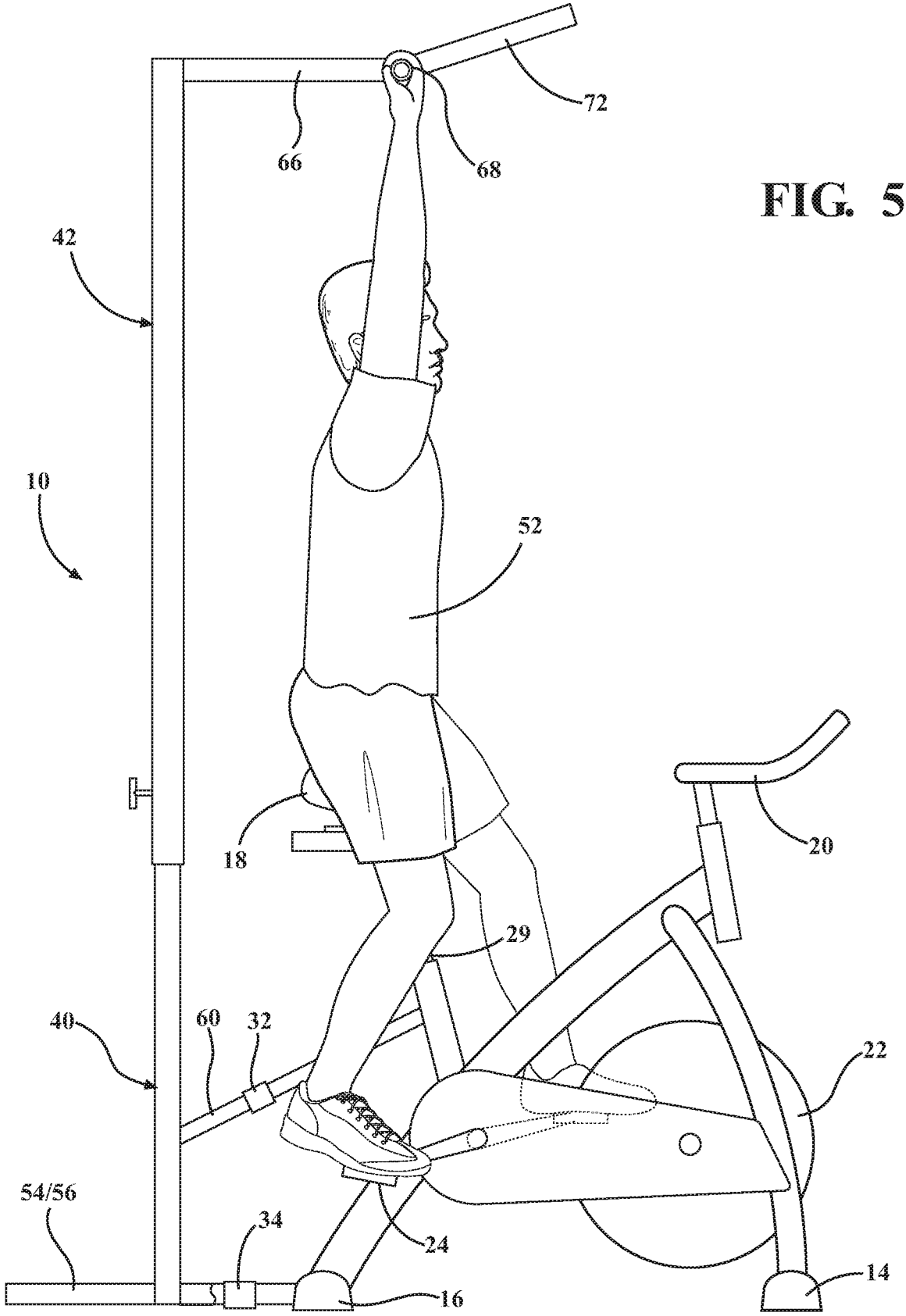
Figure 6:
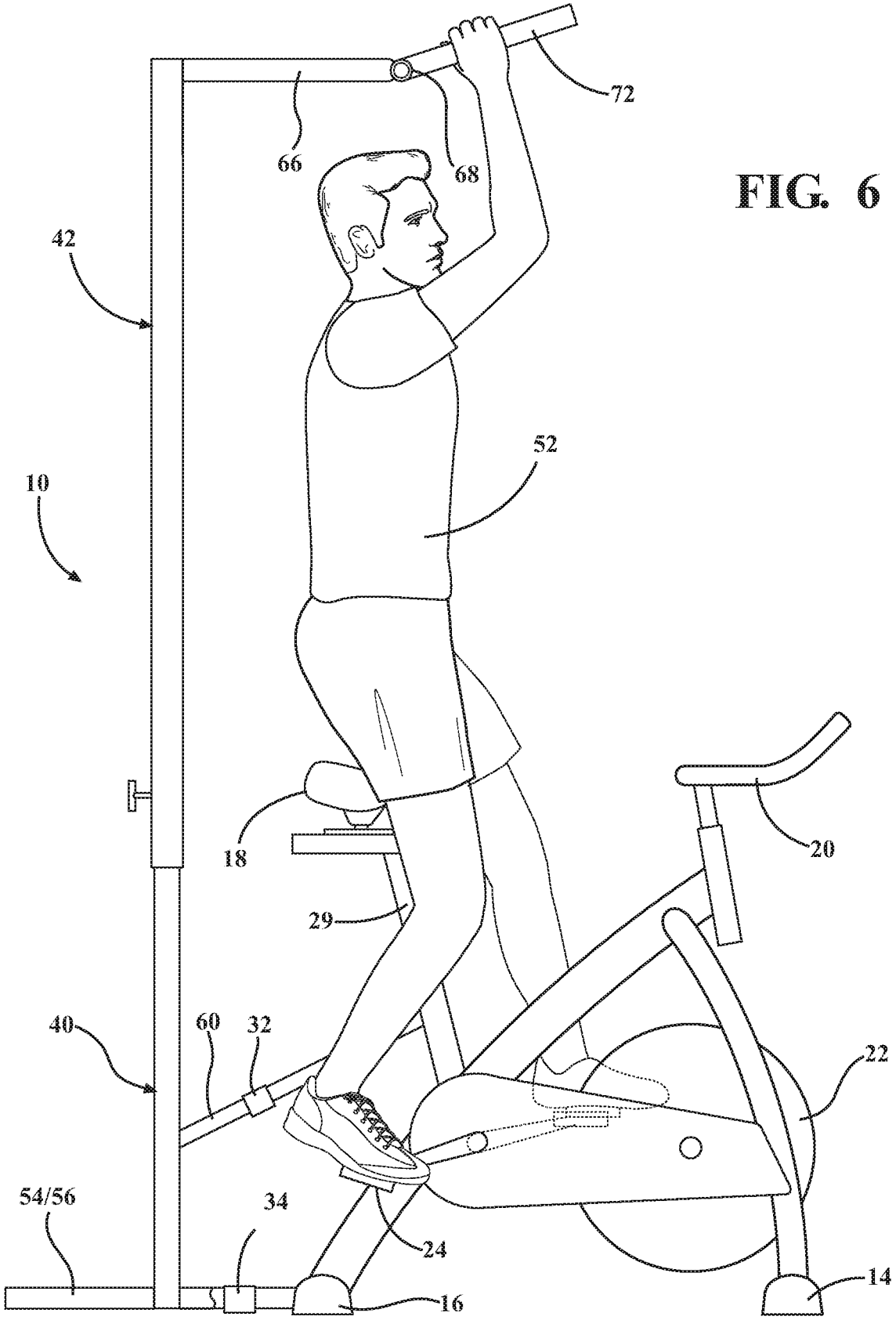

Referring to the FIGS. 1-6, an exercise bike machine system (the system) is generally shown at 10. Alluding to the above, for purposes of this patent document, the terms "or" and "and" shall mean "and/or" unless stated otherwise or clearly intended otherwise by the context of their use. The term "a" shall mean "one or more" unless stated otherwise or where the use of "one or more" is clearly inappropriate. The terms "comprise," "comprising," "include," and "including" are interchangeable and not intended to be limiting. For example, the term "including" shall be interpreted to mean "including, but not limited to."

Additionally, as used herein, the singular forms "a," "an," and "the" include plural referents unless the context clearly dictates otherwise. Thus, for example, the term "module" is intended to mean one or more modules or a combination of modules. Furthermore, as used herein, the term "based on" includes based at least in part on. Thus, a feature that is described as based on some cause, can be based only on that cause, or based on that cause and on one or more other causes.

It will be apparent that multiple embodiments of this disclosure may be practiced without some or all of these specific details. In other instances, well-known process operations have not been described in detail in order not to unnecessarily obscure the present embodiments. The following description of embodiments includes references to the accompanying drawing. The drawing shows illustrations in accordance with example embodiments. These example embodiments, which are also referred to herein as "examples," are described in enough detail to enable those skilled in the art to practice the present subject matter. The embodiments can be combined, other embodiments can be utilized, or structural, logical and operational changes can be made without departing from the scope of what is claimed. The following detailed description is, therefore, not to be taken in a limiting sense, and the scope is defined by the appended claims and their equivalents.

The system 10 includes a first frame, generally indicated at 12, presenting a front end 14 and a rear end 16. The rear end 16 includes one or more first connection members 17 extending therefrom, as shown for example in FIGS. 1 and 2. The first frame 12 supports and is attached to a seat 18, handlebars 20 and a flywheel 22, and also comprising pedals 24 rotatably attached to the first frame 12 and operatively connected to the flywheel 22. The first frame 12 further includes a rear support tube 28 adapted to receive a seat tube 29. The seat tube 29 is slidably located in the rear support tube 28. The rear support tube 28 includes a second connection member 27 extending therefrom, such as shown for example in FIGS. 1 and 2.

A second frame, generally indicated at 30, presents a mechanical connection, generally indicated at 32 and 34, for removably engaging the second frame 30 with the first frame 12. The mechanical connection 34 is disposed between the rear end 16 of the first frame 12 and the second frame 30, while the mechanical connection 32 is disposed between the second frame 30 and the rear support tube 28. The second frame 30 presents a bottom section, generally indicated at 40, and a top section, generally indicated at 42, selectively movable relative to one another along a vertical axis A. Those skilled in the art will appreciate that no mechanical connection may be included between the first and second frames 12, 30, and that the system 10 composed of the second frame 30 and the first frame 12 may be unitary.

The top section 42 presents a bar element, generally indicated at 50, to allow the user 52, to peddle the flywheel 22 by holding the bar element 50 and pull up at the bar element 50. The bottom section 40 presents a U-shaped frame 53 with a pair of support extensions 54 and 56 connected by a cross member 55, and a reinforcement member 58. The cross member 55 has a first extension element 61 extending therefrom to define the mechanical connection 34 between the second frame 30 and the rear end of the first frame 12. The reinforcement member 58 has a second extension element 60 extending therefrom to define the mechanical connection 32 between the second frame 30 and the rear support tube 28.

The top section 42 presents a second U-shaped frame 62 engaged with the U-shaped frame 53 of the bottom section 40 in male and female fashion. The bar element 50 includes a pair of upper support members 64 and 66 connected to the second U-shaped frame 62 and connected to an elongated member 68 connected perpendicularly to the upper support members 64 and 66. The bar element 50 further includes a pair of handles 70 and 72 extending perpendicularly from the elongated member 68. The elongated member 68 also includes secondary handles 74, 76 for the user 52 to use. The secondary handles 74, 76 are disposed at opposite ends of the elongated member 68 each perpendicularly extending away from respective one of the handles 70 and 72.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An exercise bike machine comprising:

a first frame having a front end and a rear end, the rear end of the first frame having a first connection member extending therefrom;

a rear support tube supported by the first frame, the rear support tube is adapted to slidably receive a seat tube that is connected to a seat adapted to support a user, the rear support tube having a second connection member extending therefrom;

handlebars, pedals, and a flywheel supported by the first frame, the pedals are rotatably and operatively connected to the flywheel; and a second frame having a U-shaped bottom frame section that is configured to mate with an inverted U-shaped top frame section such that the bottom and top frame sections are selectively movable relative one another along a vertical axis, the bottom frame section having a cross member connecting opposing ends of the bottom frame section and a reinforcement member disposed above and parallel to the cross member, the cross member having a first extension element extending therefrom and the reinforcement member having a second extension element extending therefrom;

wherein the second frame is removably connectable to the first frame by a first mechanical connection formed between the first connection member extending from the rear end of the first frame and the first extension element extending from the cross member of the second frame, and by a second mechanical connection formed between the second connection member extending from the rear support tube and the second extension element extending from the reinforcement member of the second frame; and wherein the top frame section includes a bar element that has one or more upper support members perpendicularly extending from and connected to the top frame section, an elongated member connected and perpendicularly extending relative to the one or more upper support members, and one or more handles connected to and perpendicularly extending from the elongated member to allow the user to peddle the flywheel and perform a pull-up motion by using the one or more handles of the bar element to effect heart rate, burn calories, and raise metabolism.

2. The exercise bike machine of claim 1, wherein the elongated member is parallel to the top frame section and includes a pair of secondary handles each perpendicularly extending away from a respective handle of the one or more handles.

3. The exercise bike machine of claim 2, wherein the top frame section is configured to engage the bottom frame section in male and female fashion.

4. The exercise bike machine of claim 3, wherein the bottom frame section is supported by a pair of support extensions.

5. An exercise bike machine comprising:

a first frame having a front end and a rear end, the rear end of the first frame having a first connection member extending therefrom, the first frame supporting and attached to a seat, handlebars, a flywheel, and pedals rotatably attached and operatively connected to the flywheel, the first frame including a rear support tube adapted to slidably receive a seat tube that is coupled to the seat, the rear support tube having a second connection member extending therefrom; and a second frame having a bottom frame section and a top frame section selectively movable relative to one another along an vertical axis, the bottom frame section having a cross member connecting opposing ends of the bottom frame section and a reinforcement member disposed above and parallel to the cross member, the cross member having a first extension element extending therefrom and the reinforcement member having a second extension element extending therefrom, the bottom frame section having a U-shaped frame with a pair of support extensions extending perpendicular to the cross member, the top frame section having an inverted U-shaped frame configured to engage with the U-shaped frame of the bottom frame section in male and female fashion;

wherein the second frame is removably connectable to the first frame by a first mechanical connection formed between the first connection member extending from the rear end of the first frame and the first extension element extending from the cross member of the second frame, and by a second mechanical connection formed between the second connection member extending from the rear support tube and the second extension element extending from the reinforcement member of the second frame; and wherein the top frame section includes a bar element that has one or more upper support members perpendicularly extending from and connected to the top frame section, an elongated member connected and perpendicularly extending relative to the one or more upper support members, and one or more handles connected to and perpendicularly extending from the elongated member to allow a user to peddle the flywheel and perform a pull-up motion by using the one or more handles of the bar element to effect heart rate, burn calories, and raise metabolism.

6. An exercise bike machine comprising:

a first frame having a front end and a rear end, the rear end of the first frame having a first connection member extending therefrom, the first frame supporting and attached to a seat, handlebars, a flywheel, and pedals rotatably attached and operatively connected to the flywheel, the first frame including a rear support tube adapted to slidably receive a seat tube that is coupled to the seat, the rear support tube having a second connection member extending therefrom;

a second frame having a bottom frame section and a top frame section selectively movable relative to one another along an vertical axis, the bottom frame section having a cross member connecting opposing ends of the bottom frame section and a reinforcement member disposed above and parallel to the cross member, the cross member having a first extension element extending therefrom and the reinforcement member having a second extension element extending therefrom, the bottom frame section having a U-shaped frame with a pair of support extensions extending perpendicular to the cross member, the top frame section having an inverted U-shaped frame configured to engage with the U-shaped frame of the bottom frame section in male and female fashion; and a bar element perpendicularly extending from the top frame section of the second frame, the bar element having one or more upper support members perpendicularly extending from and connected to the top frame section, an elongated member connected and perpendicularly extending relative to the one or more upper support members, and one or more handles connected to and perpendicularly extending from the elongated member, wherein the elongated member is parallel to the top frame section and includes a pair of secondary handles each perpendicularly extending away from a respective handle of the one or more handles;

wherein the second frame is removably connectable to the first frame by a first mechanical connection formed between the first connection member extending from the rear end of the first frame and the first extension element extending from the cross member of the second frame, and by a second mechanical connection formed between the second connection member extending from the rear support tube and the second extension element extending from the reinforcement member of the second frame; and wherein the one or more handles or the secondary handles allow a user to peddle the flywheel and perform a pull-up motion by using the one or more handles or the secondary handles of the bar element to effect heart rate, burn calories, and raise metabolism.

* * * * *